US008482432B2

(12) United States Patent
Mothaffar

(10) Patent No.: US 8,482,432 B2
(45) Date of Patent: Jul. 9, 2013

(54) PORTABLE TRAFFIC BARRIER WITH ILLUMINATED MESSAGE DISPLAY

(76) Inventor: Hussain Y. A. M. Mothaffar, Al-Rawda (KW)

( * ) Notice: Subject to any disclaimer, the term of this patent is extended or adjusted under 35 U.S.C. 154(b) by 0 days.

(21) Appl. No.: 13/586,343

(22) Filed: Aug. 15, 2012

(65) Prior Publication Data

US 2013/0049992 A1 Feb. 28, 2013

Related U.S. Application Data

(63) Continuation of application No. 13/219,565, filed on Aug. 26, 2011, now abandoned.

(51) Int. Cl.
*G08G 1/095* (2006.01)

(52) U.S. Cl.
USPC ..... 340/908; 340/907; 340/815.4; 340/471; 340/473; 345/1.1; 345/1.3; 345/901; 40/610

(58) Field of Classification Search
USPC ..... 340/908, 908.1, 944, 471, 473, 907, 340/815.4; 345/1.1, 1.3, 901, 905; 40/610, 40/612; 116/63 R, 63 P
See application file for complete search history.

(56) References Cited

U.S. PATENT DOCUMENTS

| | | | | |
|---|---|---|---|---|
| 4,535,331 | A * | 8/1985 | Koenig | 340/908 |
| 2004/0174597 | A1* | 9/2004 | Craig et al. | 359/484 |
| 2005/0210722 | A1* | 9/2005 | Graef et al. | 40/452 |
| 2009/0291242 | A1* | 11/2009 | Owens, III | 428/35.7 |
| 2011/0012751 | A1* | 1/2011 | Jones | 340/825.69 |

OTHER PUBLICATIONS

Prior art cited in parent U.S. Appl. No. 13/219,565, filed Aug. 26, 2011, the priority of which is claimed herein.

* cited by examiner

*Primary Examiner* — Hung T. Nguyen
(74) *Attorney, Agent, or Firm* — Richard C. Litman

(57) ABSTRACT

The portable traffic barrier with illuminated message display includes at least one lightweight panel having a rigid frame and a matrix of separate illumination units therein. The illumination units are flexibly secured to one another within the panel by links extending between adjacent units. Each illumination unit includes two mutually opposed faces, either or both faces providing illumination from a plurality of small lighting elements (e.g., LEDs) therein. Some of the units may be non-illuminated, if desired. The panel includes an electrical power supply capable of providing power to the illumination units from a solar panel, a portable electrical supply, or from the local power grid, if available. In at least one embodiment, the panel may be folded in accordion fashion for more compact storage when not deployed. A plurality of such panels may be interconnected mechanically and electrically to provide a comprehensive traffic message, if desired.

9 Claims, 8 Drawing Sheets

PORTABLE TRAFFIC BARRIER WITH ILLUMINATED MESSAGE DISPLAY

CROSS-REFERENCE TO RELATED APPLICATIONS

This is a continuation of my prior application Ser. No. 13/219,565, filed Aug. 26, 2011 abandoned.

BACKGROUND OF THE INVENTION

1. Field of the Invention

The present invention relates generally to fences, partitions, and similar barriers, and particularly to a portable traffic barrier with illuminated message display that is lightweight and may comprise one or more panels that are mechanically and electrically linked together to display a comprehensive lighted message.

2. Description of the Related Art

A good many traffic barriers and the like are relatively massive in order to be relatively immobile in the event of impact by a vehicle, e.g., the so-called "Jersey wall" or "Jersey barrier" of solid, precast concrete. While such concrete barriers may be moved into position by heavy equipment, many are left in place as permanent installations, particularly in areas of dense traffic. Such concrete barriers are certainly not readily portable. Moreover, while such barriers may be provided with passive reflectors, they are not wired for electrical lighting and are therefore incapable of displaying electrically illuminated messages to drivers.

Alternatively, there are a large number of relatively small and lightweight portable barriers available. Most of these portable barriers are of the "sawhorse" configuration, i.e., a pair of folding legs at each end of a transverse horizontal panel or element. If such simple portable barriers have any form of illumination at all, it is nearly universally in the form of a single light that conveys no information other than that there is an object associated with the light. Such simple portable barriers are much too small to provide any meaningful traffic information and cannot be linked together to provide a comprehensive message, either by active or passive illumination.

Portable message boards and the like for vehicular traffic are also known. Such devices are generally mounted on a small trailer or the like for portability. These portable traffic signboards are relatively short in order to be mounted on a small trailer, so that their messages must be kept relatively short or be displayed in relatively small text over multiple lines. Oftentimes, it can be difficult to read such a message while traveling at speed in heavy traffic, even though they may be illuminated for night operation.

Thus, a portable traffic barrier with illuminated message display solving the aforementioned problems is desired.

SUMMARY OF THE INVENTION

The portable traffic barrier with illuminated message display includes at least one panel having a rigid peripheral frame and a matrix of separate, mutually independent illumination units suspended therein. Each of the units contains a plurality of lighting elements therein, preferably in the form of small light emitting diodes (LEDs). Each of the illumination units includes mutually opposed first and second faces, either or both faces having lighting elements visible therein. In some instances, non-illuminating units may be included in the matrix, if desired. All of the illumination units in a panel are electrically interconnected, and may be individually and independently illuminated in order to display a predetermined message.

Each panel includes a power supply capable of providing electrical power to each of the illumination units. The electrical power may be provided by a solar panel, by a portable electrical source (such as the electrical system of a motor vehicle), or by the local electrical power grid, when available. The power supply includes switching means to select the appropriately available electrical power source. The power supply may also contain an integral electrical storage battery, which may provide some additional mass for stability of the lightweight panel to which the power supply is attached. Additional stability may be provided by a removable ballast weight attached to one or more of the legs of each panel.

An extensive or comprehensive message may be provided by interconnecting a number of panels together, the individual illumination units of each panel being selectively illuminated to form the desired message. The panels are quickly and easily linked together mechanically and electrically, and just as quickly and easily separated for storage or transport. In at least one embodiment, the panels may be folded in accordion fashion for more compact storage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable traffic barrier with illuminated message display is formed of one or more panels, each of the panels having a matrix of electrically illuminated units therein. The illuminated units may be selectively activated to form a message. In at least one embodiment, the panel may be folded or collapsed in accordion fashion for compact storage and transport.

Figure 1:
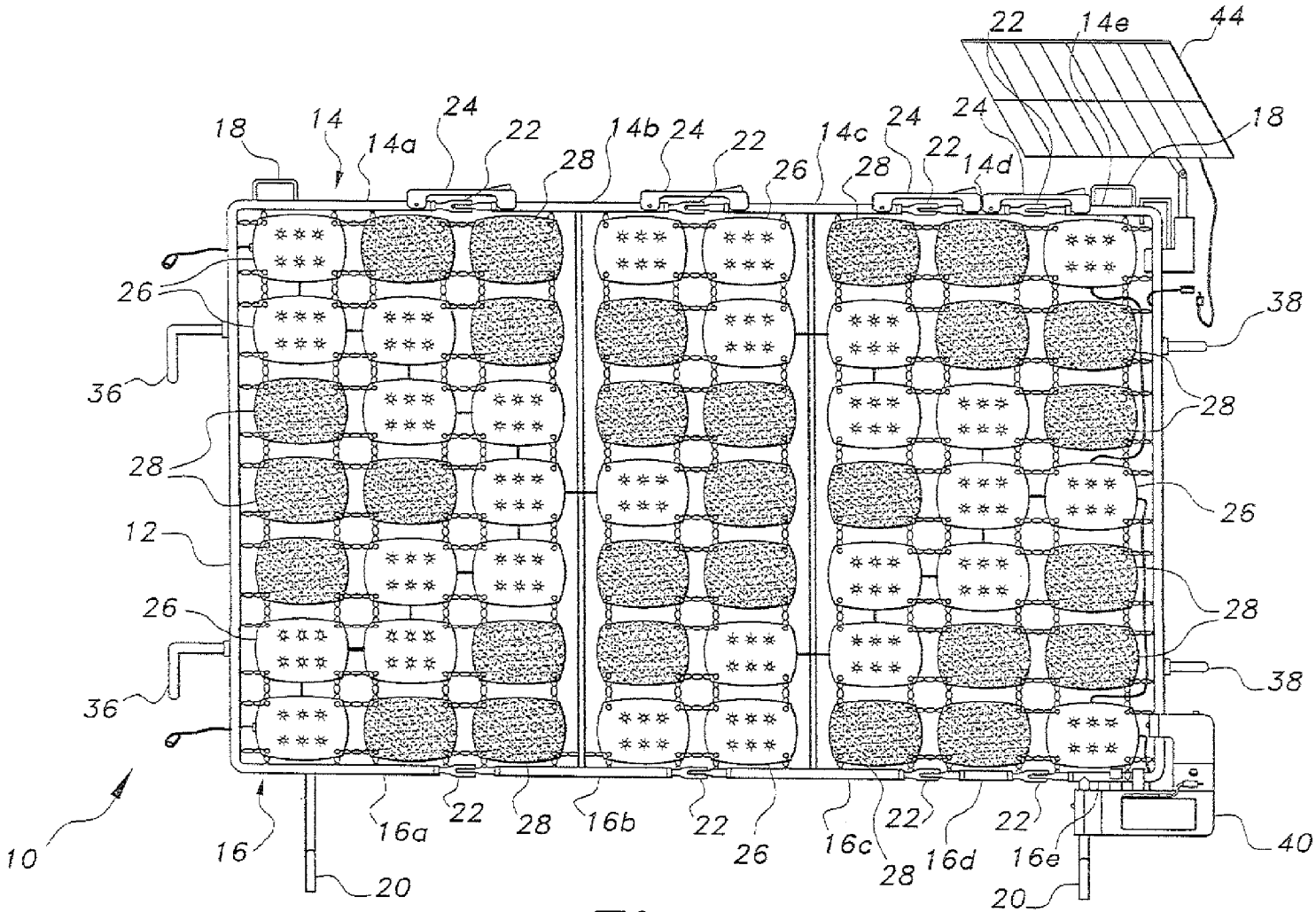
FIG. 1 is a front elevation view of a single panel of a portable traffic barrier with illuminated message display according to the present invention, illustrating its general features.
Figure 3:
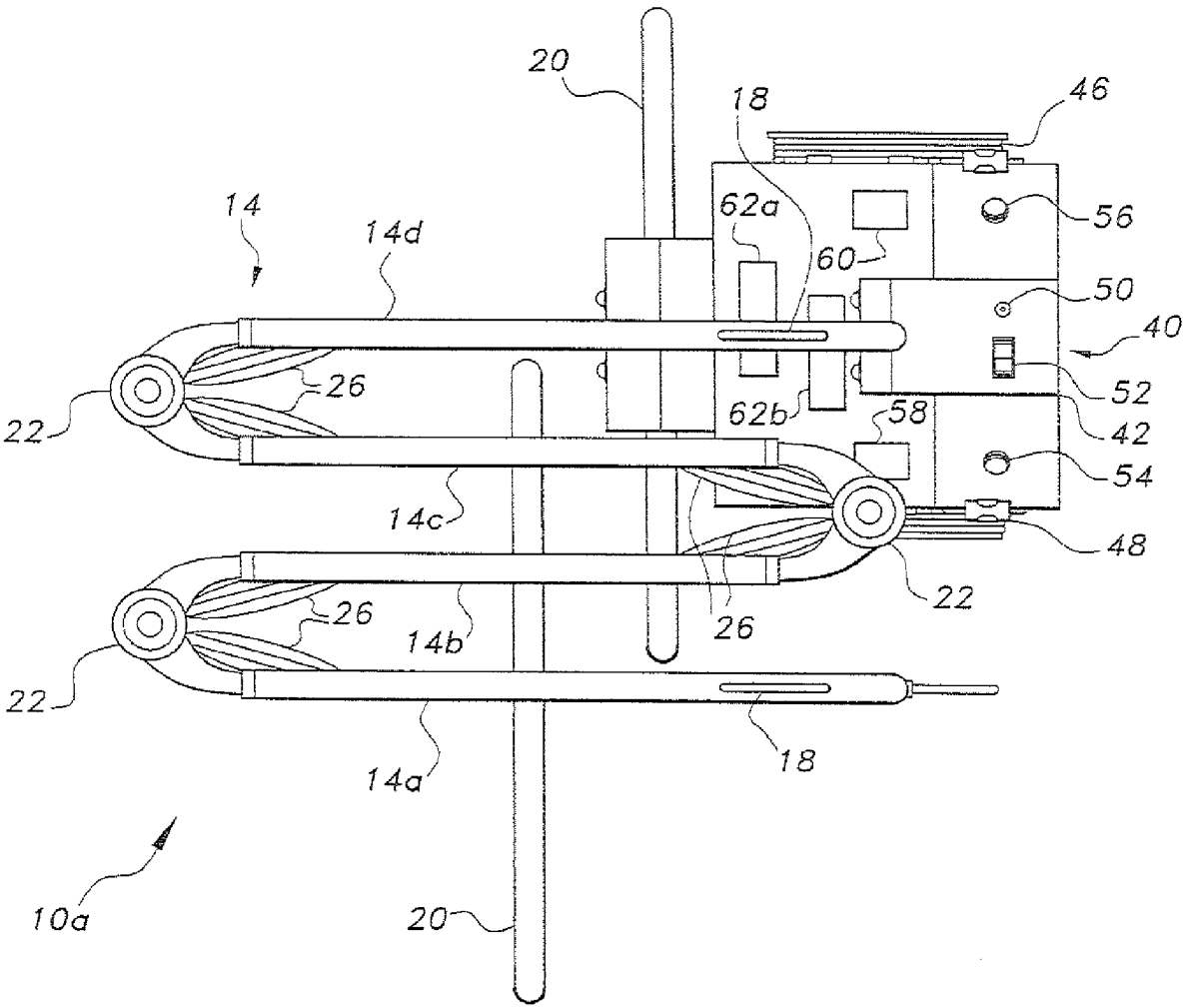
FIG. 3 is a top plan view of a single panel of the portable traffic barrier with illuminated message display according to the present invention, showing its folded configuration.

FIG. 1 of the drawings provides an illustration of an exemplary panel 10 having a matrix or array of electrically lighted units therein. The panel 10 comprises a lightweight peripheral frame 12, preferably formed of tubular elements. The material may be plastic or metal. A lightweight metal, such as aluminum, provides further advantage in serving as an electrical ground path to obviate the need for additional ground wiring. The panel 10 of FIG. 1 may be folded for compact storage and transport. The folding mechanism is shown in detail in FIGS. 3 and 4. The frame 12 of each panel 10 includes a folding top member 14 and bottom member 16. The top member 14 has handles 18 extending therefrom, and the bottom member 16 includes a pair of legs 20 extending therefrom. The top member 14 is formed of a series of shorter segments, e.g., 14*a* through 14*e*, as shown in FIG. 1. The top plan view of FIG. 3 illustrates a slightly simplified version of this folding panel structure 10*a*, having only four segments 14*a* through 14*d*. The bottom member is formed of a like series of segments, e.g., 16*a* through 16*e* as shown in FIG. 1.

Figure 4:
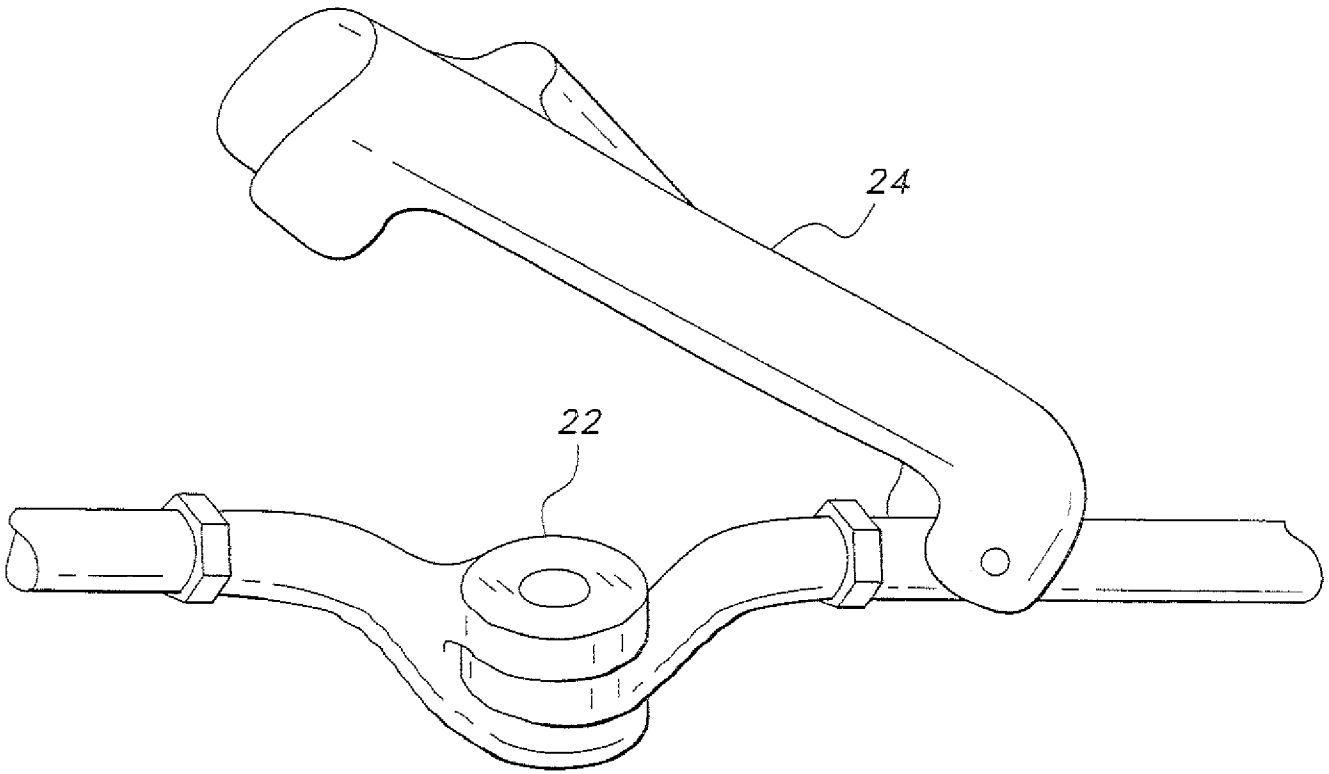
FIG. 4 is a detailed perspective view of a single hinge joint and latch mechanism of a portable traffic barrier with illuminated message display according to the present invention.

Each of these segments is joined to its adjacent member by a hinge or knuckle 22, as shown in detail in FIG. 4. The hinges or knuckles 22 are laterally offset from the plane of the panel 10 in an alternating array to opposite sides of the panel 10 when it is extended in order to allow for the thickness of the frame structure 12 and its illumination elements when the panel is folded, as shown in the top plan view of FIG. 3. The upper member 14 of the frame 12 further includes a latch 24 (shown in detail in FIG. 4) at each hinge knuckle 22. The latches 24 pivot over the frame member segment to each side of the hinge 22 to lock the segments in their extended configuration when the panel 10 is erected. The latches 24 are only needed along either one of the top or bottom members 14 and 16, as the rigid nature of the sides or ends of the panel frame 12 results in the opposite members retaining the same configuration as one another, whether extended or folded.

Figure 5:
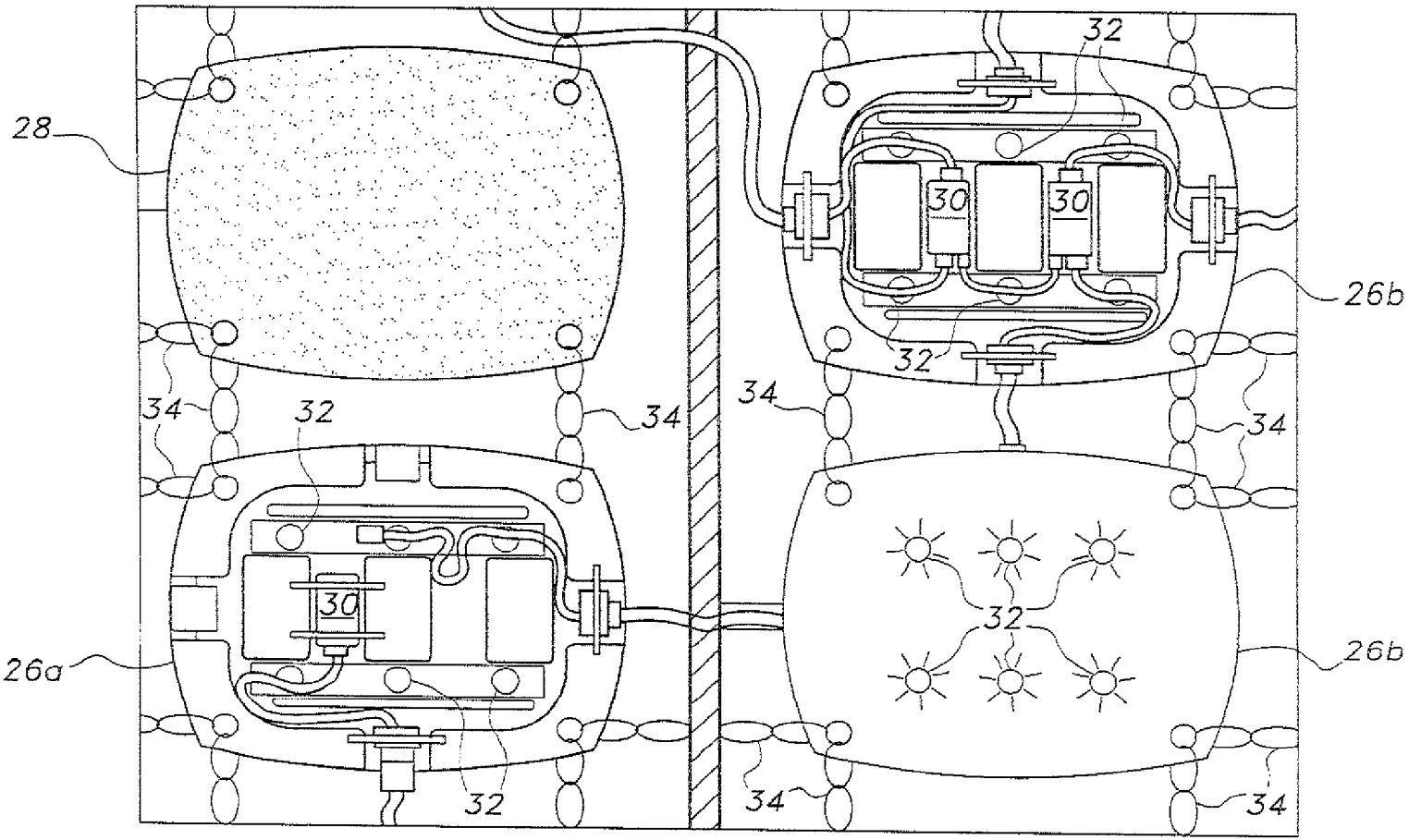
FIG. 5 is a detailed front elevation view of various display units of a portable traffic barrier with illuminated message display according to the present invention, illustrating various details thereof.

Each panel 10 includes a matrix of separate, individual illumination units 26 therein, linked mechanically and electrically with one another in an array substantially coplanar with the panel frame 12. It will be seen in the example of FIG. 1 that the illumination units 26 are installed in the frame 12 with additional unlighted units 28, the illumination units 26 forming a series of directional arrows. FIG. 5 provides a detailed view of a plurality of illumination units disposed in a planar array, the planar array including a single unlighted unit 28. There are two types or configurations of illumination units illustrated in FIG. 5, including a first type 26*a* illuminated only to one side or face thereof, and a second type 26*b* providing illumination to both mutually opposed sides or faces. (The generic reference numeral 26 used in FIG. 1 may be used to designate either single illuminated face or double illuminated face units.)

It will be noted in FIG. 5 that the single illuminated face illumination unit 26*a* to the lower left contains only a single power distributor or flasher 30 therein to provide electrical power to a plurality of lighting elements 32 (e.g., LEDs, or other lighting elements), which are visible from both the front and the rearward face of the illustrated open illumination unit 26*a* to the lower left in FIG. 5. Alternatively, a pair of such distributors or flashers 30 may be installed within a single illumination unit 26*b*, as in the ease of the two illumination units 26*b* to the right side in FIG. 5. One such distributor or flasher 30 provides electrical power to the lighting elements 32 disposed within one of the faces of the illumination units 26*b*, e.g., those in the rearward face of the unit, while the other distributor or flasher 30 provides electrical power to the lighting elements 32 disposed in the forward side or face of the element, as shown in the assembled element 26*b* of the lower right portion of FIG. 5. These various illumination units 26*a* ad 26*b* and unlighted units 28 may be arranged in any manner desired within the matrix or array of the panel 10. It should also be noted that the matrix or array may be composed entirely of illuminated units 26*a* and/or 26*b*, having electrical power provided selectively to the units in a pattern that forms a user-selectable illuminated message or pattern. This may be accomplished by means of conventional computer programming, or alternatively, merely by selectively connecting and disconnecting power to the various units in the desired pattern.

The various illumination units 26 and unlighted units 28 are not rigidly secured within the peripheral frame 12 of the panel 10, but are flexibly linked together with one another and with the frame by chain links 34. This allows the various units 26 and 28 to move slightly within the plane of the frame 12 to accommodate the folding of the frame, illustrated in the top plan view of FIG. 3. This flexible mounting of the units 26 and 28 also allows them to move slightly to accommodate minor impacts without damage. Alternative attachment means may be used to secure the units 26 and 28 within the frame 12, e.g., plastic ties, cables, or cords, etc. Preferably, some form of linked elements is used, as the links provide security for the electrical wiring extending between various illumination units 26.

Figure 2:
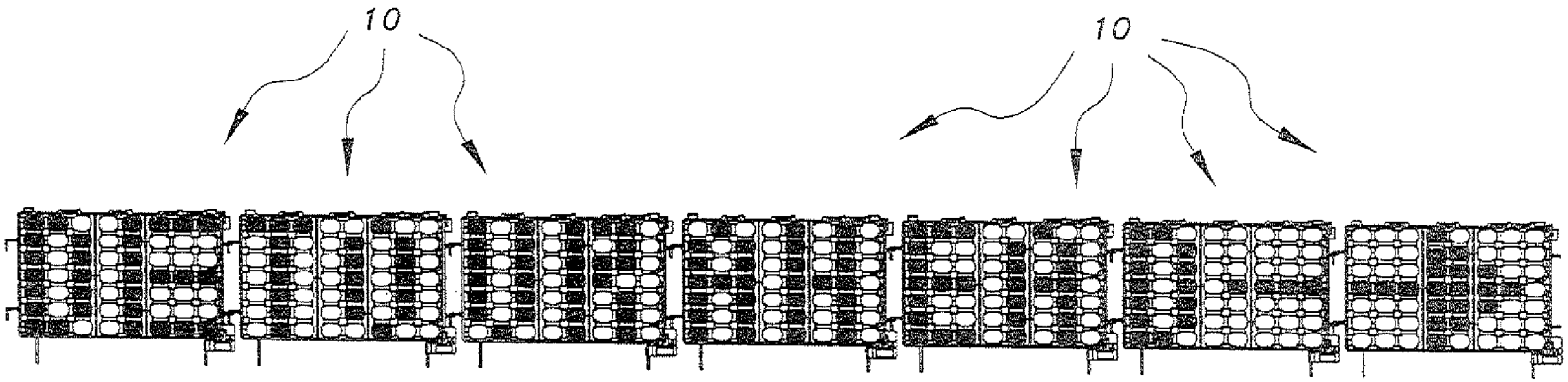
FIG. 2 is a front elevation view of a plurality of connected panels of a portable traffic barrier with illuminated message display according to the present invention, displaying the exemplary message "DETOUR AHEAD→" thereon in dark letters against a light background.

Returning to FIG. 1, it will be noted that the left end of the frame 12 includes a pair of pintles or hooks 36 extending therefrom, while the opposite right end of the flame includes a pair of eyes 38 extending therefrom. These hooks and eyes 36 and 38 permit a series of panels 10 to be connected mechanically to one another in a linear array, generally as shown in FIG. 2 of the drawings. The illumination units may be programmed or connected electrically to form a message or display, as in the "DETOUR AHEAD→" message displayed in the series of panels 10 of FIG. 2. It should be noted in FIG. 2 that the message is displayed in darker units while the surrounding units are lighter. This is to allow the message to show up more readily in the illustration. Normally, the message itself would be lighter than the surrounding unlighted units, but the various illuminated and unlighted units may be arranged in any desired pattern or manner.

Figure 6:
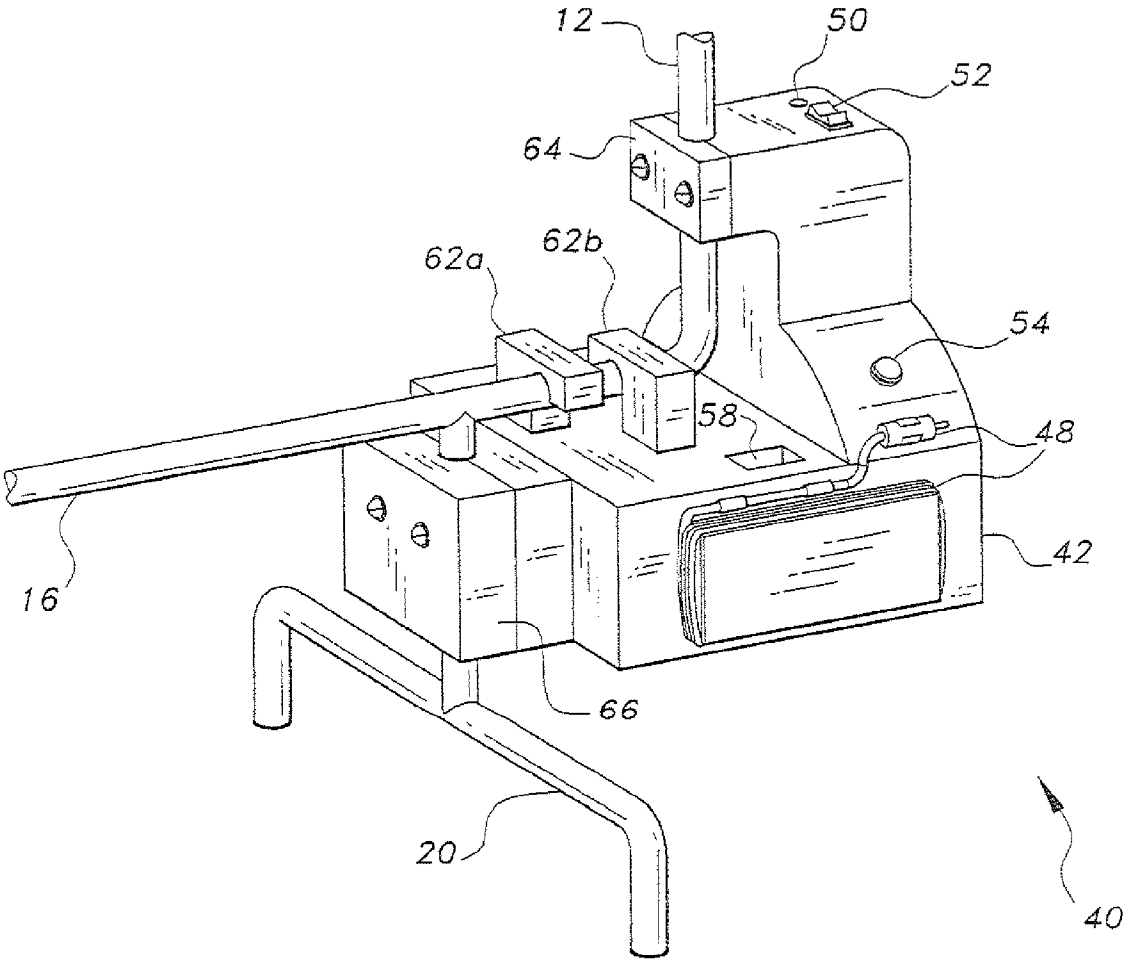
FIG. 6 is a detailed perspective view of an exemplary electrical power supply for a single panel of the portable traffic barrier with illuminated message display according to the present invention, illustrating various features thereof.

The single panel illustration of FIG. 1 also shows an electrical power supply 40 disposed at the lower right corner of the frame 12. FIGS. 3 and 6 of the drawings provide detailed views of this power supply 40. The power supply 40 provides a great deal of versatility in the selection of the type of electrical power to be used for powering the various illumination units 26 of the device. The power supply 40 includes a relatively large case or housing 42 for containing a conventional electrical storage battery therein, but provision is also made for other forms of electrical power as well. For example, FIG. 1 illustrates a solar panel 44 that may be attached to the frame 12 to recharge the battery during daylight periods. A cord and connector plug 46 are provided for connecting the solar panel 44 to the housing 42 and its internal battery, the cord and connector plug 46 being shown in their stowed positions in FIG. 3. Alternatively, the illumination units 26 may be powered from a conventional twelve-volt power supply, e.g., from a nearby motor vehicle. A twelve-volt power cord 48 and plug are provided opposite the solar power cord and connector plug 46, as illustrated in FIGS. 3 and 6. The device may also accept electrical power from a conventional electrical grid or network by means of an adapter receptacle 50.

A master power switch, e.g., rocker switch 52, is provided for controlling power output from the power supply 40. Alternatively, a key-activated or other locking type switch may be installed to prevent tampering by unauthorized individuals if the panel 10 is left unattended. Additional first and second power control switches, e.g., pushbutton switches 54 and 56, are provided for selecting electrical power to either or both sides of the illumination units. These two switches 54 and 56 may also be locking type switches, if desired. These two switches 54 and 56 control power to first and second side power outlets or receptacles 58 and 60, to which appropriate power cords may be connected to provide power for the selected side(s) of the illumination units 26.

The power supply 40 is supported from the frame 12 of the panel 10 by means of a pair of laterally opposed hook or catch members 62*a* and 62*b* that catch or hook over the lower member 16 (or segment thereof) of the frame 12. Additional attachments comprise an upright frame member clamp 64 that bolts or otherwise secures to the upper portion of the housing 42 about the upright member of the frame 12, and a leg clamp 66 that bolts or otherwise secures to one end of the housing 42 about the upright portion of the frame support leg 20.

Figure 7:
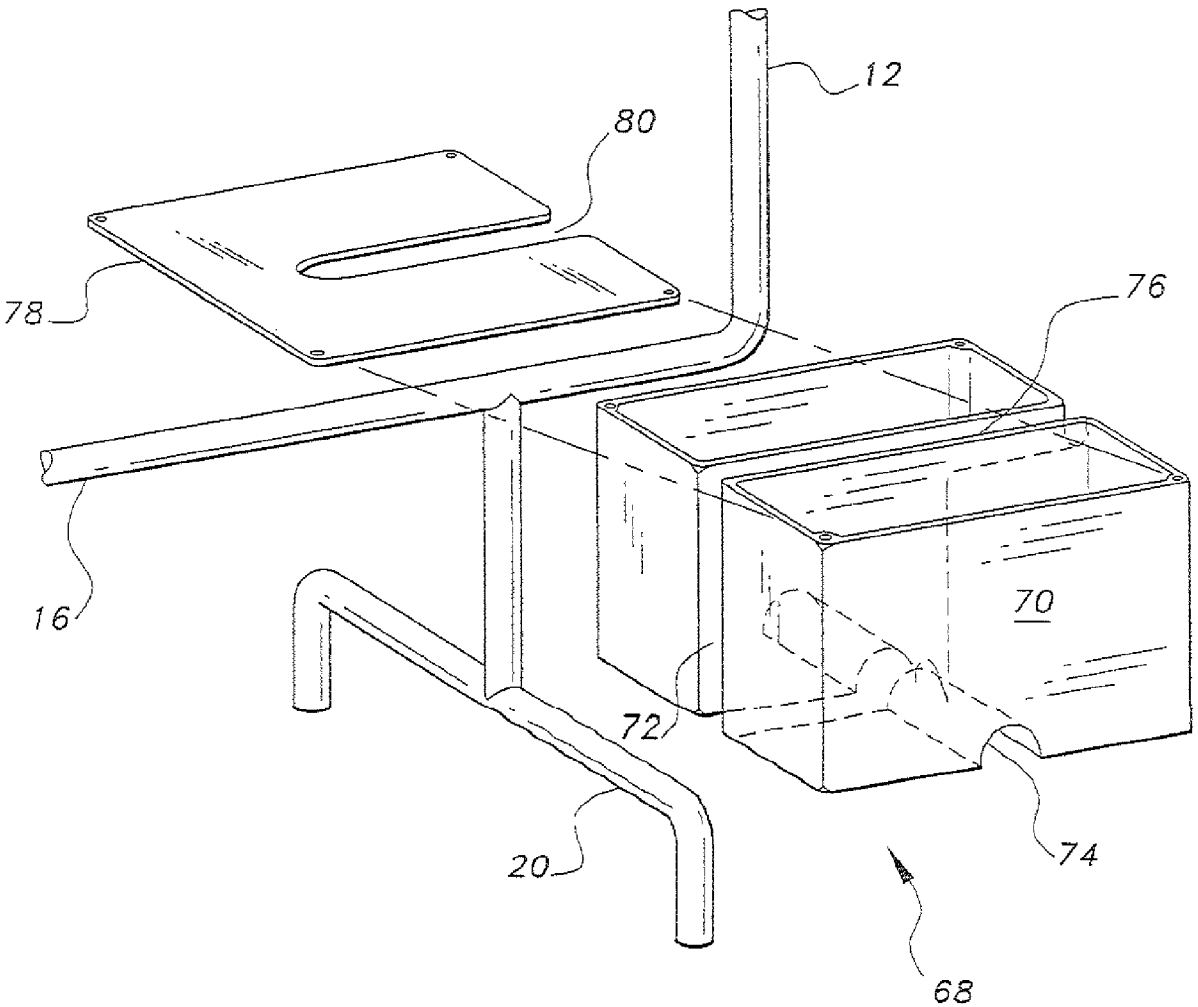
FIG. 7 is a partial exploded perspective view of a ballast weight for a single panel of a portable traffic barrier with illuminated message display according to the present invention, illustrating its removable attachment to the frame of the barrier.

The power supply 40 and its internal battery provide considerable ballast for the lower portion of the panel 10, for stability. However, additional stability may be provided by means of a separate ballast weight 68 that is removably secured to the frame 12, as shown in FIG. 7 of the drawings. The ballast weight 68 comprises a hollow box 70 that may be filled with any suitably massive material (earth, sand, water, concrete, etc.). The ballast box 70 includes a vertical slot 72 that extends the entire depth of the box and approximately halfway along its length. This slot 72 fits around the upright portion of the flame support leg 20, as shown in the exploded view of FIG. 7. A lateral channel 74 across the bottom of the box 70 fits over the lateral portion of the leg 20, and a longitudinal channel 76 extends along the upper portion of the box 70 from the vertical slot 72 to the opposite, outboard end of the box 70. A cover plate 78 has a longitudinal slot 80 therein, adapted to fit around the upright portion of the frame 12 when the ballast assembly is installed thereon. The cover plate 78 is firmly attached (e.g., conventional screws, etc.) to the otherwise open upper surface of the ballast box 70, once the box 70 has been filled with suitable ballast material and placed on and over the frame 12 and support leg 20.

Figure 8:
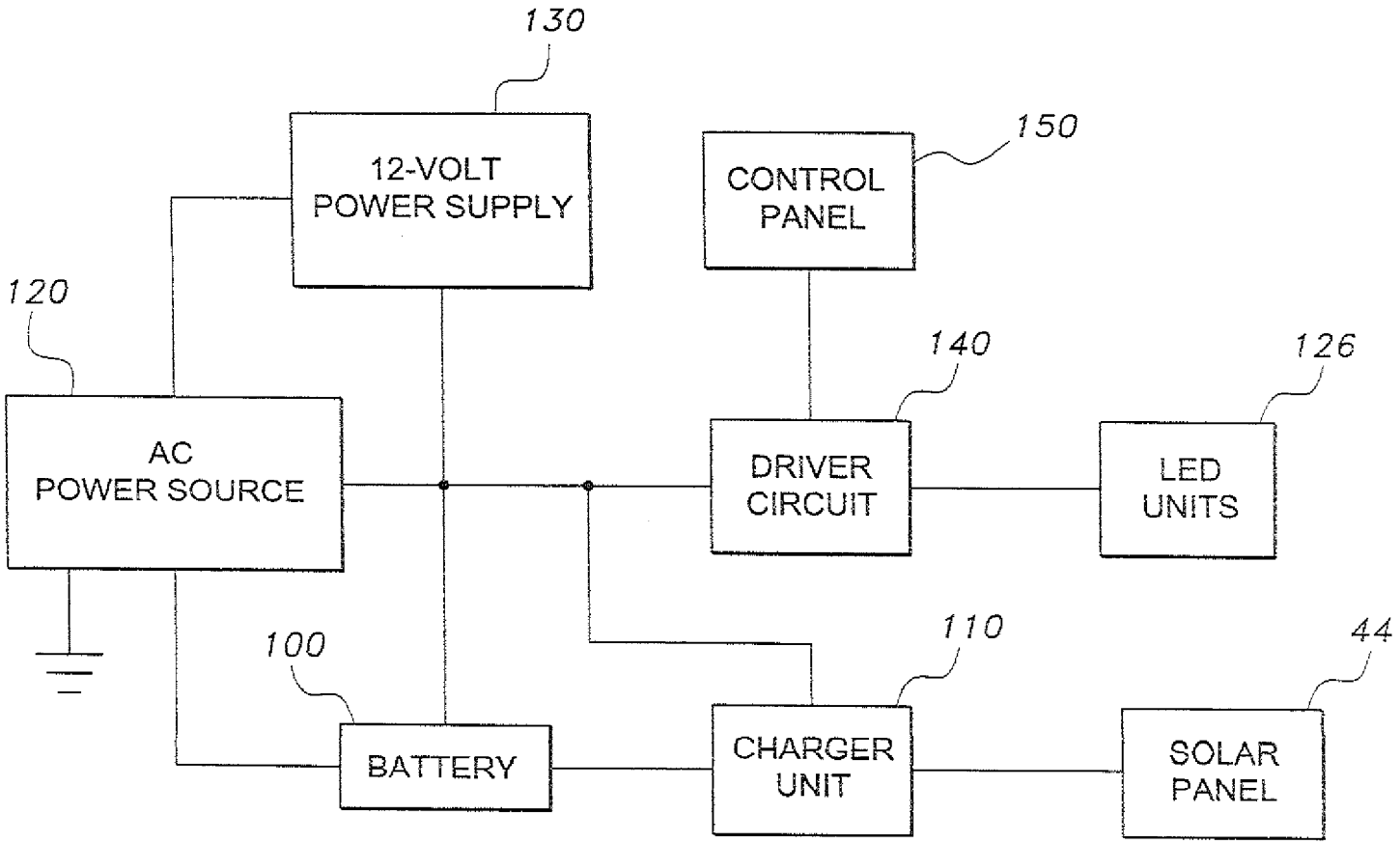
FIG. 8 is a block diagram of electric circuits and components in a portable traffic barrier with illuminated message display according to the present invention.

As shown in FIG. 8, the portable traffic barrier 10 includes a battery 100 that may optionally be connected to a solar panel 44 by a charging circuit 110 that charges the battery during daylight hours, or the solar panel 44 may be used to power the driver, illumination, and control panel circuits directly. Alternatively, the illumination units or LEDs 26 may be powered by an a.c. power source 120 plugged into the adapter receptacle 50, or by a 12-volt power source 130. The power source is connected to a driver circuit 140 for driving the LED illumination units 26. A controller or control panel circuit 150 having a user interface and a processor permitting the user to program a desired message for display by the LED illumination units 26 is connected to the driver circuit 140. All of these circuit components are conventional, and need not be described further.

It is to be understood that the present invention is not limited to the embodiments described above, but encompasses any and all embodiments within the scope of the following claims.

I claim:

1. A portable traffic barrier with illuminated message display, comprising:

a plurality of panels, each having a lightweight peripheral frame, the frame having mutually opposed top and bottom members, the top and bottom members each having a plurality of hinge joints therein, the hinge joints of each of the members being laterally offset on opposite front and back sides of the respective members in an alternating array, the frame being adapted for folding in accordion fashion at the hinge joints for storage;

wherein said plurality of panels being mechanically and electrically connected to one another in a linear array;

a matrix of physically and electrically independent illumination units disposed within each said frame in a substantially planar array;

wherein each of the illumination units has mutually opposed first and second faces, at least one of the faces being selectively illuminated; and said illumination units are flexibly linked to one another.

2. The portable traffic barrier with illuminated message display according to claim 1, wherein each of the illumination units includes a plurality of lighting elements therein.

3. The portable traffic barrier with illuminated message display according to claim 1, further comprising at least one ballast weight removably attached to the frame.

4. The portable traffic barrier with illuminated message display according to claim 1, further comprising an electrical power supply, the power supply operating from an electrical power source selected from the group consisting of solar power, battery power, portable electrical power, and electrical distribution grid power.

5. A portable traffic barrier with illuminated message display, comprising:

a plurality of panels, each panel having a lightweight peripheral frame, and said plurality of panels being mechanically and electrically connected to one another in a linear array;

wherein the frame includes mutually opposed top and bottom members, the top and bottom members each having a plurality of hinge joints therein, the hinge joints of each of the members being laterally offset on opposite front and rear sides of the respective member in an alternating array, the frame being adapted for folding at the hinge joints in accordion fashion for storage;

a matrix of physically and electrically independent illumination units disposed within each frame in a substantially planar array, each of the illumination units having a plurality of lighting elements therein;

wherein said illumination units are flexibly linked to one another, and each of the illumination elements has mutually opposed first and second faces, at least one of the faces being selectively illuminated; and an electrical power supply, the power supply operating from an electrical power source selected from the group consisting of solar power, battery power, portable electrical power, and electrical distribution grid power.

6. The portable traffic barrier with illuminated message display according to claim 5, further comprising at least one ballast weight removably attached to the frame.

7. A portable traffic barrier with illuminated message display, comprising:

a plurality of panels, each panel having a lightweight peripheral frame;

wherein the frame includes mutually opposed top and bottom members, the top and bottom members each having a plurality of hinge joints therein, the hinge joints of each of the members being laterally offset on opposite front and rear sides of the respective member in an alternating array, the frame being adapted for folding at the hinge joints in accordion fashion for storage;

a matrix of physically and electrically independent illumination units disposed within each frame in a substantially planar array, the illumination elements being flexibly linked to one another;

wherein each of the illumination units includes a plurality of lighting elements therein;

wherein said at least one panel comprises a plurality of said panels mechanically and electrically connected to one another in a linear array; and wherein each of the illumination units has mutually opposed first and second faces, at least one of the faces being selectively illuminated.

8. The portable traffic barrier with illuminated message display according to claim 7, further comprising at least one ballast weight removably attached to the frame.

9. The portable traffic barrier with illuminated message display according to claim 7, further comprising an electrical power supply, the power supply operating from an electrical power source selected from the group consisting of solar power, battery power, portable electrical power, and electrical distribution grid power.

* * * * *